US008729377B2

(12) United States Patent
Nakagawa et al.

(10) Patent No.: US 8,729,377 B2
(45) Date of Patent: May 20, 2014

(54) GENERATING TONES WITH A VIBRATO EFFECT

(75) Inventors: Mizuki Nakagawa, Shizuoka-ken (JP); Shun Takai, Shizuoka-ken (JP)

(73) Assignee: Roland Corporation, Hamamatsu (JP)

( * ) Notice: Subject to any disclaimer, the term of this patent is extended or adjusted under 35 U.S.C. 154(b) by 200 days.

(21) Appl. No.: 13/397,566

(22) Filed: Feb. 15, 2012

(65) Prior Publication Data

US 2012/0227573 A1 Sep. 13, 2012

(30) Foreign Application Priority Data

Mar. 8, 2011 (JP) ..... 2011-050107

(51) Int. Cl.
*G10H 1/02* (2006.01)

(52) U.S. Cl.
USPC ..... 84/624; 84/609; 84/629

(58) Field of Classification Search
USPC ..... 84/624
See application file for complete search history.

(56) References Cited

U.S. PATENT DOCUMENTS

| | | | | |
|---|---|---|---|---|
| 4,558,624 | A * | 12/1985 | Tomisawa et al. | 84/626 |
| 5,272,274 | A | 12/1993 | Kimura | |
| 5,763,807 | A * | 6/1998 | Clynes | 84/705 |
| 6,946,595 | B2 * | 9/2005 | Tamura et al. | 84/629 |
| 2009/0249943 | A1 * | 10/2009 | Tanaka et al. | 84/604 |

FOREIGN PATENT DOCUMENTS

| | | |
|---|---|---|
| JP | 1198797 | 8/1989 |
| JP | 2199500 | 8/1990 |
| JP | 8286665 | 11/1996 |

OTHER PUBLICATIONS

English machine translation of JP06-083334 published Mar. 25, 1994 by Yamaha Corp.
English machine translation of JP06-348267 published Dec. 22, 1994 by Kawai Musical Instr Mfg Co Ltd.
English machine translation of JP08-286665 published Nov. 1, 1996 by Yamaha Corp.
"How to Use Vibrato in Electronic Music Production", Sonic Transfer, [online][retrieved Jan. 15, 2012] http://sonictransfer. com/vibrato-electronic-music-production-tutorial.shtml, pp. 1-5.

* cited by examiner

*Primary Examiner* — Christopher Uhlir
(74) *Attorney, Agent, or Firm* — Konrad Raynes Davda & Victor LLP; David W. Victor

(57) ABSTRACT

Provided are a method, computer storage device, and tone control device for generating tones with a vibrato effect. A determination is made of a key depression interval comprising a difference of a current time of a current note from a previous time of a previous note. A performance mode is set to a single tone mode, in which only one note is generated, or a polyphonic mode, in which multiple notes are simultaneously generated, based on the determined key depression interval. The tone is generated to output the current note with a first modulation magnitude in response to determining that the performance mode is the single tone mode. A tone is generated to output the current note with a second modulation magnitude in response to determining that the performance mode is the polyphonic mode, wherein the first modulation magnitude is greater than the second modulation magnitude.

20 Claims, 4 Drawing Sheets

GENERATING TONES WITH A VIBRATO EFFECT

CROSS-REFERENCE TO RELATED FOREIGN APPLICATION

This application is a non-provisional application that claims priority benefits under Title 35, United States Code, Section 119(a)-(d) from Japanese Patent Application entitled "TONE CONTROL DEVICE" by Mizuki NAKAGAWA and Shun TAKAI, having Japanese Patent Application Serial No. 2011-050107, filed on Mar. 8, 2011, which Japanese Patent Application is incorporated herein by reference in its entirety.

BACKGROUND OF THE INVENTION

1. Field of the Invention

The present invention relates to a method, computer storage device, and tone control device for generating tones with a vibrato effect.

2. Description of the Related Art

Electronic musical instruments such as synthesizers and the like can generate tones with various kinds of tone colors. When performance of a natural musical instrument is imitated by an electronic musical instrument, it is necessary to make the tone colors to be faithfully imitated to tone colors of the natural musical instrument. In addition, the performer needs to understand the characteristic peculiar to the musical instrument and needs to perform while operating user interfaces of the musical instrument (such as, for example, the keyboard, the pitch-bend lever, the modulation lever, the HOLD pedal and the like) during his or her performance. Therefore, when the performer attempts to imitate performance of a certain musical instrument, using an electronic musical instrument, the performer needs to have good understanding of the characteristic of the musical instrument to be imitated, and is required to have high-level skills in performance technique to make full use of the user interfaces according to the characteristic during performance.

For example, when the vibrato effect is added to tones, the LFO (Low Frequency Oscillator) depth in pitch and level is assigned to the user interfaces such as a modulation lever. The performer manually operates the user interfaces according to the performance state, thereby adjusting the amount of vibrato. Therefore, for adding the vibrato effect, the performer needs to have high-level performance skills.

In this respect, in recent years, electronic musical instruments automatically add the vibrato effect to tones according to the state of performance. Among those electronic musical instruments, there is an electronic musical instrument that variably controls the amount of vibrato according to velocity. However, these electronic musical instruments add the vibrato effect for a single note even in polyphony performance. Therefore, when performance of a solo musical instrument that is capable of polyphony, such as, a violin is imitated, the performance would sound artificial. One of the reasons for this artificiality is that for a solo musical instrument capable of polyphony, such as, a violin, when the performer plays polyphonic notes, vibrato added for a single note tends not to be added for polyphonic notes due to the structural problem of the musical instrument.

Japanese Patent Publication No. JP2199500 describes an electronic musical instrument that is capable of changing the effect according to the number of keys depressed, when the tone color of a piano is selected.

SUMMARY

Provided are a method, computer storage device, and tone control device for generating tones with a vibrato effect. A current note-on event at a current time is received. A determination is made of a key depression interval comprising a difference of the current time from a previous time of a previous note. A performance mode in the memory device is set to a single tone mode, in which only one note is generated, or a polyphonic mode, in which multiple notes are simultaneously generated, based on the determined key depression interval. The tone is generated to control a sound source to output the current note with a first modulation magnitude in response to determining that the performance mode is the single tone mode. A tone is generated to control the sound source to output the current note with a second modulation magnitude in response to determining that the performance mode is the polyphonic mode, wherein the first modulation magnitude is greater than the second modulation magnitude.

DETAILED DESCRIPTION

Figure 1:
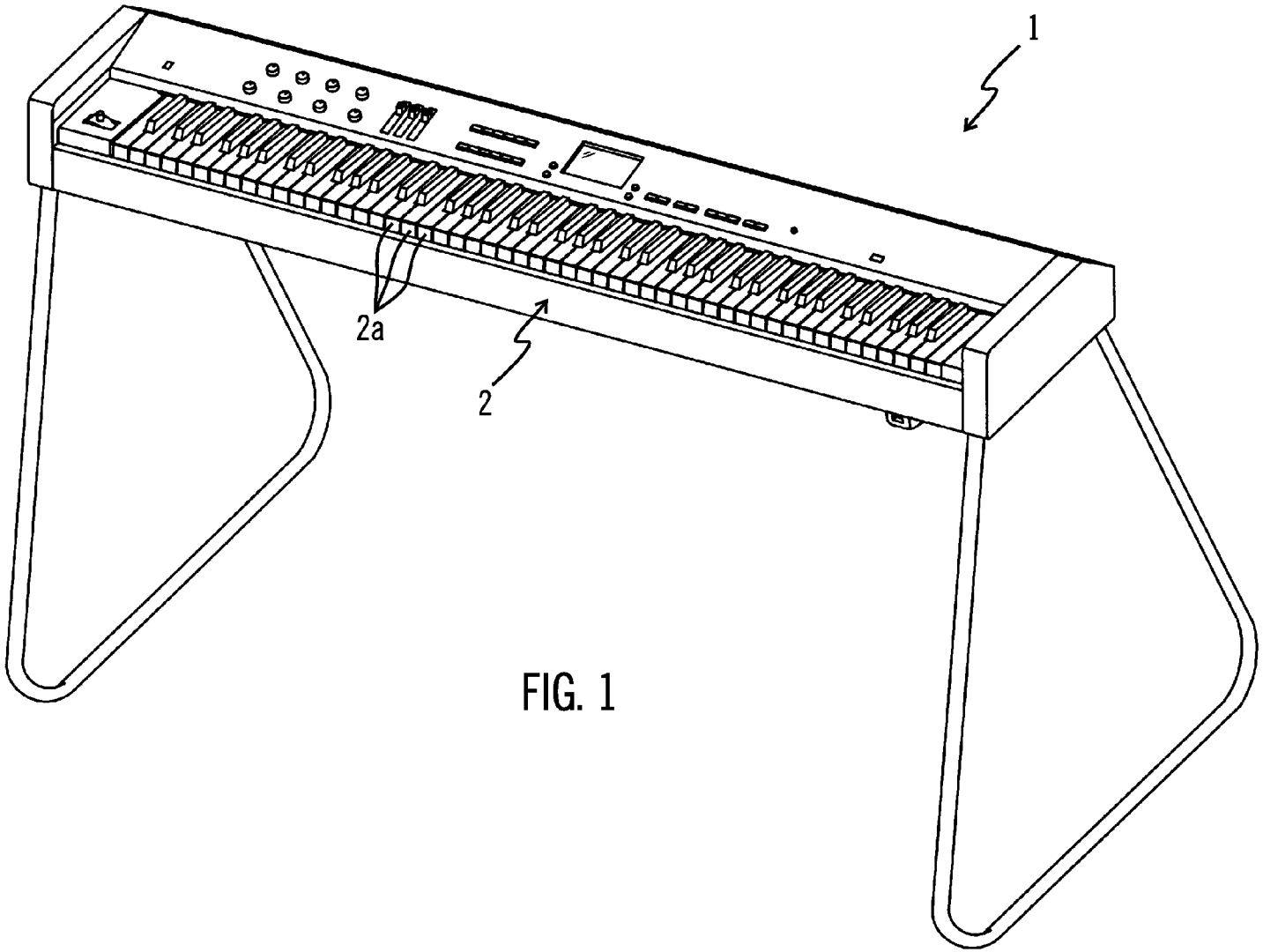
FIG. 1 is an external appearance of an electronic musical instrument provided with a tone control device in accordance with an embodiment of the invention.

Described embodiments relate to tone control devices and, more particularly, to a tone control device that is capable of highly sophisticated imitation of performance of a solo musical instrument capable of polyphony (for example, a violin and the like) based on real-time performance operation by the performer.

In prior art systems, such as the electronic musical instrument described in Japanese Patent Publication No. JP2199500, the decision of whether to add an effect to the tones, such as a vibrato effect, is based solely according to the number of keys depressed. Therefore, when multiple keys are depressed, no discrimination is made as to whether key-depression of these multiple keys is intended for polyphony (i.e., a chord), or key-depression is intended for individual notes, and the same effect is added for both of them. Therefore, such prior art technology is not sufficient for imitating a solo musical instrument capable of polyphony.

Described embodiments provide a tone control device that is capable of imitating performance of a solo musical instrument capable of polyphony, such as, a violin to a higher degree.

In described tone control device embodiments, an interval judgment device judges as to whether or not an input interval between a current tone generation instruction and a last tone generation instruction is equal to a predetermined time or less. When the interval judgment device judges that the input interval between the current tone generation instruction and the last tone generation instruction is not equal to the predetermined time or less, it is assumed that the current tone generation instruction has been inputted with an intention not to perform polyphony with respect to the last tone generation instruction (in other words, with an intention to perform a single tone). Then, an instruction device instructs a tone generation device to set the amount of tone modulation to a predetermined value. On the other hand, when the interval judgment device judges that the input interval between the current tone generation instruction and the last tone generation instruction is equal to the predetermined time or less, it is assumed that the current and last tone generation instructions are given based on polyphony performance. Then, the instruction device instructs the tone generation device to set the amount of tone modulation to a value smaller than the predetermined value. In other words, based on the input interval between the current tone generation instruction and the last tone generation instruction, it is discriminated as to whether the current tone generation instruction has been made in polyphonic performance together with the last tone generation instruction, or not in polyphonic performance (in other words, made in performance of a single tone). When it is judged to be of polyphonic performance, the amount of tone modulation is made smaller (suppressed), compared to the case where a single tone is performed.

Therefore, with certain described embodiments, when the performer plays notes with an intention to perform polyphony, the amount of tone modulation (for example, the magnitude of the vibrato effect) is made smaller. Accordingly, when imitating performance of a solo musical instrument capable of polyphony such as a violin through real-time performance operation by the performer, highly sophisticated imitation that sufficiently reflects the characteristic of the solo musical instrument can be realized.

In further embodiments, when the number of tones being generated, which is counted by a count device, is counted down to one, the instruction device instructs the tone generation device to set the amount of tone modulation to a predetermined value. More specifically, when tones that are generated in polyphony are gradually silenced, and when there remains only a single tone being generated, the amount of tone modulation for the tone being generated is set to the same amount of modulation as that for a single tone. Therefore, the amount of tone modulation that is suppressed as a result of the judgment of polyphony is returned to the modulation for a single tone, when there remains only one single tone being generated. Therefore, it is possible to realize highly sophisticated imitation that sufficiently reflects the characteristic of a solo musical instrument in which vibrato tends to be given to a single tone (a solo musical instrument capable of polyphony), such as, a violin.

In further embodiments, when the interval judgment device judges that the input interval between the current tone generation instruction and the last tone generation instruction is equal to the predetermined time or less, it is assumed that the current tone generation instruction and the last tone generation instruction are given based on polyphony performance. Then, the instruction device instructs the tone generation device to set a poly mode that is capable of concurrently generating two or more tones. In other words, it is effective in that a tone based on the current tone generation instruction can be generated together with a tone being generated based on the last tone generation instruction. On the other hand, when the interval judgment device judges that the input interval between the current tone generation instruction and the last tone generation instruction is not equal to the predetermined time or less, it is assumed that the current tone generation instruction has been inputted with an intention not to perform polyphony with respect to the last tone generation instruction (in other words, with an intention to perform a single tone). Then, the instruction device instructs the tone generation device to set a mono mode that prohibits concurrent generation of two or more tones. Therefore, while tones are being generated based on the performance of polyphony, when a tone generation instruction newly inputted by the performer (the current tone generation instruction) is inputted in an input interval not less than the predetermined time (in other words, exceeding the predetermined time) from the last tone generation instruction, the tone generation device is set to the mono mode. In other words, when it is judged, based on the input interval between the current tone generation instruction and the last tone generation instruction, that the current tone generation instruction has been inputted (performed) with an intention to play a single tone, a tone based on the current tone generation instruction (in other words, a tone performed with an intention to play a single tone) alone is generated. Therefore, more sophisticated imitation that better reflects the characteristic of a solo musical instrument capable of polyphony such as a violin can be realized.

In a further embodiment, when the interval judgment device judges that the input interval between the current tone generation instruction and the last tone generation instruction is equal to the predetermined time or less, it is assumed that the current tone generation instruction and the last tone generation instruction are given based on polyphony performance. Then, the instruction device instructs the tone generation device to set a poly mode that is capable of concurrently generating two or more tones. In other words, it is effective in that a tone based on the current tone generation instruction can be generated together with a tone being generated based on the last tone generation instruction. Meanwhile, when the number of tones being generated, which is counted by the count device, is counted down to one, the instruction device instructs the tone generation device to set a mono mode that prohibits concurrent generation of two or more tones. Therefore, when tones that are generated in polyphony are gradually silenced, and when there remains only a single tone being generated, the tone being generated can be generated as a single tone in the mono mode. Therefore, it is possible to realize highly sophisticated imitation that better reflects the characteristic of a solo musical instrument capable of polyphony such as a violin.

Embodiments are described with reference to the accompanying drawings. FIG. 1 is an external appearance of an electronic musical instrument 1 provided with a tone control device in accordance with an embodiment of the invention. As shown in FIG. 1, the electronic musical instrument 1 is an electronic keyboard musical instrument having a keyboard 2 composed of a plurality of keys 2*a*. A performer can play a performance piece by depressing or releasing the keys 2*a* of the keyboard 2 of the electronic musical instrument 1.

The keyboard 2 is one of the user interfaces operated by the performer. The keyboard 2 outputs to a CPU 11 (see FIG. 2) note events that are pieces of performance information according to the MIDI (Musical Instrument Digital Interface) standard in response to key-depression and key-release operations on the keys 2*a* by the performer. More specifically, when the key 2*a* is depressed by the performer, the keyboard 2 outputs to the CPU 11 a note-on event (hereafter referred to as a "note-on") that is a piece of performance information indicating that the key 2*a* is depressed. On the other hand, when the key 2*a* that has been depressed by the performer is released, the keyboard 2 outputs to the CPU 11 a note-off event (hereafter referred to as a "note-off") that is a piece of performance information indicating that the depressed key 2*a* is released.

When the performer performs a key-depression intended for a single tone, the electronic musical instrument 1 may add a vibrato effect with a predetermined vibrato depth to a tone corresponding to the key depressed. On the other hand, when the performer performs a key-depression intended for polyphony, the electronic musical instrument 1 may correct the vibrato depth to a value smaller than the value to be added to a single tone, such as zero. As the electronic musical instrument 1 has such a configuration, performance of a solo musical instrument capable of polyphony such as a violin can be realized to a highly sophisticated level.

Figure 2:
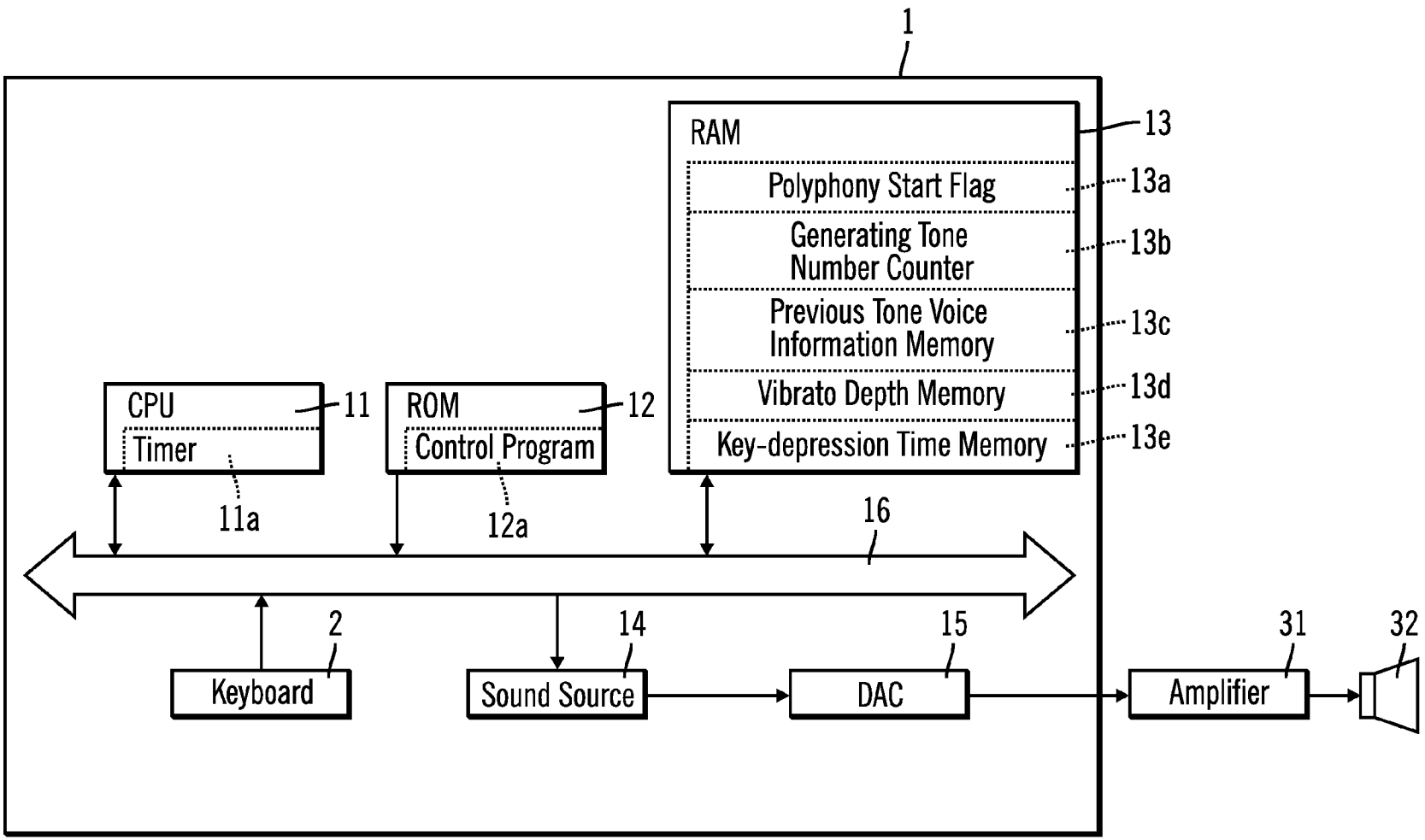
FIG. 2 is a block diagram of an electrical composition of the electronic musical instrument.

FIG. 2 is a block diagram showing an electrical composition of the electronic musical instrument 1. As shown in FIG. 2, the electronic musical instrument 1 includes a CPU 11, a ROM 12, a RAM 13, and a sound source 14; and the components 11-14 and the keyboard 2 are mutually connected through a bus line 16. A tone control device may be formed from the CPU 11, the ROM 12 and the RAM 13. The electronic musical instrument 1 also includes a digital-to-analog converter (DAC) 15. The DAC 15 is connected to the sound source 14, and is also connected to an amplifier 31 that is provided outside the electronic musical instrument 1.

The CPU 11 is a central control unit that controls each of the components of the electronic musical instrument 1 according to fixed value data and a control program stored in the ROM 12 and the RAM 13. The CPU 11 includes a built-in timer that counts clock signals, thereby measuring the time.

Upon receiving a note-on (a piece of performance information indicating that one of the keys 2*a* is depressed) from the keyboard 2, the CPU 11 outputs a tone generation instruction to the sound source 14, thereby rendering the sound source 14 to start generation of a tone (an audio signal) according to the note-on. Also, upon receiving a note-off (a piece of performance information indicating that one of the keys 2*a* that has been depressed is released) from the keyboard 2, the CPU 11 outputs a silencing instruction to the sound source 14, thereby performing a silencing control. By this, the tone that is being generated by the sound source 14 is stopped.

The ROM 12 is a non-rewritable memory, and stores a control program 12*a* to be executed by the CPU 11, fixed value data (not shown) to be referred to by the CPU 11 when the control program 12*a* is executed, and the like. The fixed value data includes values of vibrato depth to be applied to single tones. The processes shown in the flow chart of FIG. 4 may be executed by the control program 12*a*.

The RAM 13 is a rewritable memory, and has a temporary storage area for temporarily storing various kinds of data for the CPU 11 to execute the control program 12*a*. The temporary area of the RAM 13 is provided with a polyphony start flag 13*a*, a generating tone number counter 13*b*, a previous tone voice information memory 13*c*, a vibrato depth memory 13*d*, and a key-depression time memory 13*e*.

The polyphony start flag 13*a* is a flag that is used to identify a note-on to be processed initially (first) when a performance intended for polyphony (in other words, key-depression of a chord) is executed by the performer. The polyphony start flag 13*a* is initialized (set to OFF) when the electronic musical instrument 1 is powered on. Then, the polyphony start flag 13*a* is set to ON, upon key-depression of the key 2*a*, each time when the key-depression interval between the current key-depression and the last key-depression exceeds a predetermined time (20 milliseconds (msec) in the present embodiment), or the last key-depression does not exist. When the key 2*a* is depressed, if the key-depression interval between the current key-depression and the last key-depression is equal to the predetermined time or less, it is identified that the current key-depression and the last key-depression are intended to be key-depressions for polyphony. In this instance, if the polyphony start flag 13*a* is ON, the note-on by the last key-depression is identified as a note-on that is processed first among the key-depressions intended for polyphony. In this manner, when the note-on that is first processed among the key-depressions intended for polyphony is identified, the polyphony start flag 13*a* is set to OFF.

The generating tone number counter 13*b* is a counter for counting the number of tones being generated. The generating tone number counter 13*b* is initialized (zeroed) when the electronic musical instrument 1 is powered on, is incremented by one each time the key 2*a* is key-depressed, and is decremented by one each time the key 2*a* is key-released. Also, when the key-depression interval between the current key-depression and the last key-depression exceeds the predetermined time, the generating tone number counter 13*b* is once zeroed, before the addition based on the current key-depression is executed.

The previous tone voice information memory 13*c* is a memory for managing information relating to a voice-assigned voice based on the last key-depression (hereafter referred to as "previous tone voice information"), when the key 2*a* is key-depressed. The previous tone voice information memory 13*c* is initialized (zeroed) when the electronic musical instrument 1 is powered on. Each time the CPU 11 receives a note-on from the keyboard 2 upon key-depression of the key 2*a*, previous tone voice information is stored in the previous tone voice information memory 13*c*. The previous tone voice information includes information indicative of a voice assigned (voice-assigned) to the note-on received among 128 tone generation channels provided in the sound source 14, and the like. The voice may be composed of one or a plurality of tone generation channels.

The vibrato depth memory 13*d* is a memory for storing vibrato depth indicative of the depth of vibrato effect. The vibrato depth stored in the vibrato depth memory 13*d* is supplied to the sound source 14, whereby a vibrato effect with a magnitude according to the supplied vibrato depth is given to a tone to be generated. The vibrato depth memory 13*d* is initialized (zeroed) when the electronic musical instrument 1 is powered on.

The vibrato depth memory 13*d* stores a vibrato depth stored in the ROM 12 (the vibrato depth applied to a single tone) as an initial value each time the CPU 11 receives a note-on from the keyboard 2 upon key-depression of the key 2*a*. The vibrato depth stored in the vibrato depth memory 13*d* as an initial value may be corrected to zero when the key-depression interval between the current key-depression and the last key-depression is equal to 20 msec or less. By this, the vibrato effect to be added to a tone becomes zero. Therefore, according to the electronic musical instrument 1, when the performer depresses keys of a chord, intended for polyphony, vibrato is not added to each of the tones composing polyphony, such that the characteristic of a solo musical instrument capable of polyphony (for example, a violin) can be imitated.

Also, the vibrato depth stored in the vibrato depth memory 13*d* is corrected again to the initial value (in other words, the vibrato depth to be applied to a single tone) when the number of remaining tones being generated reduces to 1 due to key-release of the keys 2*a*. By this, the vibrato effect to be applied to a single tone changes again, from zero, to a magnitude according to the vibrato depth to be applied to a single tone. In other words, the electronic musical instrument 1 in accordance with the present embodiment is configured such that, when multiple tones being generated as polyphonic are gradually reduced to one remaining tone (i.e., a single tone), vibrato with a magnitude according to the vibrato depth to be applied to a single tone is again added to the single tone. Therefore, according to the electronic musical instrument 1, it is possible to imitate the characteristic of a solo musical instrument in which vibrato is not added to polyphony, but vibrato is added to a single tone, such as, a violin.

The key-depression time memory 13*e* is a memory for storing key-depression times sequentially in the order of key-depressions. The key-depression time memory 13*e* is initialized when the electronic musical instrument 1 is powered on. Then, each time the CPU 11 receives a note-on from the keyboard 2, the time measured by the timer 11*a* is stored as a key-depression time in the key-depression time memory 13*e*, together with a note (a note number) indicated by the received note-on. The present embodiment is configured to store a predetermined number of (for example, 10) latest key-depression times in the order of key-depressions. However, the present embodiment may be configured such that, when the key 2*a* is key-released, the key-depression time of the corresponding note may be erased. The key-depression interval of keys that are successively depressed is calculated by a difference between the key-depression time of the current key-depression and the key-depression time of the last key-depression based on the stored content of the key-depression time memory 13*e*.

Also, the temporary area of the RAM 13 is provided with a note-on map (not shown). The note-on map is a map that indicates as to whether or not a tone corresponding to each of the keys 2*a* is being generated. More specifically, the note-on map is composed of tone generation flags associated with notes (note numbers) corresponding to the respective keys 2*a*, and indicates a voice of the sound source 14 assigned to each of the notes. When a tone generation instruction is outputted to the sound source 14, a tone generation flag of a note corresponding to the tone generation instruction is set to ON, and information indicative of an assigned voice is stored. On the other hand, when a silencing instruction is outputted to the sound source 14, a tone generation flag of a note corresponding to the silencing instruction is set to OFF, and information indicative of the corresponding voice is erased.

The sound source 14 generates (emanates) tones with a tone color set by the performer at pitches corresponding to those of the keys 2*a* depressed or stops tones that are being generated, based on tone generation instructions or silencing instructions received from the CPU 11, respectively. Upon receiving a tone generation instruction from the CPU 11, the sound source 14 generates a tone (an audio signal) with a pitch, a volume and a tone color according to the tone generation instruction. Tone signals outputted from the sound source 14 are supplied to the DAC 15, converted into analog signals by the DAC 15, and outputted (emanated) from the speaker 32 through the amplifier 31. On the other hand, upon receiving a silencing instruction from the CPU 11, the sound source 14 stops the tone being generated according to the silencing instruction. The tone being emanated from the speaker 32 is silenced accordingly.

The sound source 14 has 128 tone generation channels (not shown). Each of the voices is provided with an LFO (not shown) that outputs a low frequency oscillation signal. The tone generated through each voice is modified (in other words, a vibrato effect is added) by the low frequency oscillation signal outputted from the LFO of that voice. The magnitude of the vibrato effect, in other words, the magnitude of the modulation can be changed by changing LFO_Pitch_Depth and LFO_TVA_Depth among setting values set for each voice. In certain embodiments, a parameter deciding table (see FIG. 3) (to be described below) is looked up based on the vibrato depth stored in the vibrato depth memory 13*d*, thereby deciding LFO_Pitch_Depth and LFO_TVA_Depth to be applied to each voice.

Figure 3:
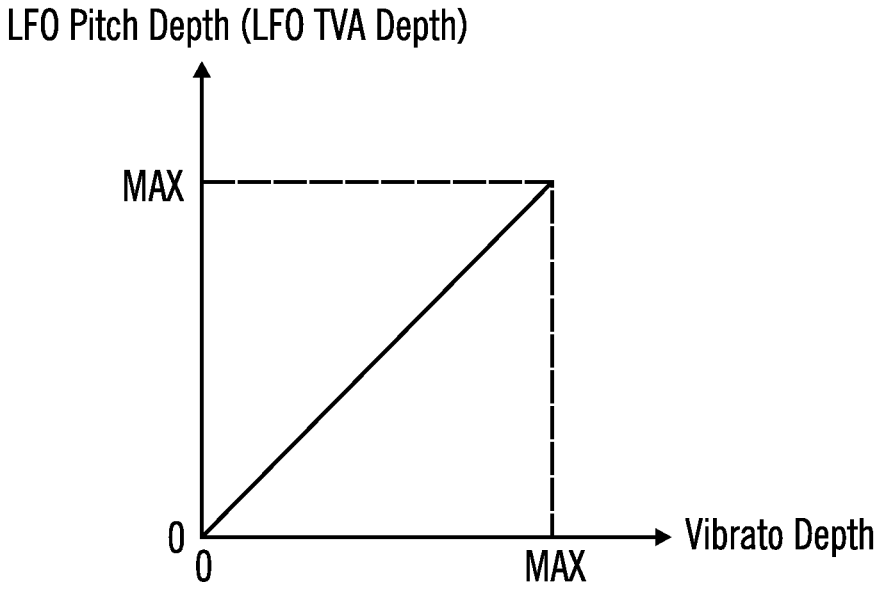
FIG. 3 is a graph for explaining contents of a parameter deciding table.

Referring to FIG. 3, the aforementioned parameter deciding table will be described. FIG. 3 is an explanatory view showing contents of the parameter deciding table presented in a graph. In FIG. 3, the horizontal axis shows values of the vibrato depth, and "MAX" on the horizontal axis indicates a maximum value of the vibrato depth. On the other hand, the vertical axis shows values of LFO_Pitch_Depth, and "MAX" on the vertical axis indicates a maximum value of the LFO_Pitch_Depth. It is noted that, in the following description, the relation between the vibrato depth and the LFO_Pitch_Depth will be described, which is similarly applicable to the relation between the vibrato depth and the LFO_TVA_Depth. In other words, "LFO_Pitch_Depth" in the following description made with reference to FIG. 3 may be interchangeable with "LFO_TVA_Depth."

As shown in FIG. 3, according to the parameter deciding table in accordance with described embodiments, a linearly proportional relation is set between the vibrato depth and the LFO_Pitch_Depth. The LFO_Pitch_Depth is decided through referring to the parameter deciding table based on the vibrato depth stored in the vibrato depth memory 13*d*.

In the example shown in FIG. 3, the LFO_Pitch_Depth has a linearly increasing relation with respect to increase in the vibrato depth. However, the vibrato depth and the LFO_Pitch_Depth are not limited to a linearly increasing relation, but may have a logarithmically increasing relation (a convex upward monotonically increasing relation or a convex downward monotonically increasing relation) or the like. Also, the vibrato depth and the LFO_Pitch_Depth may be correlated differently for different tone colors, for example, may be linearly correlated for one tone color, but may be logarithmically correlated for another tone color.

Figure 4:
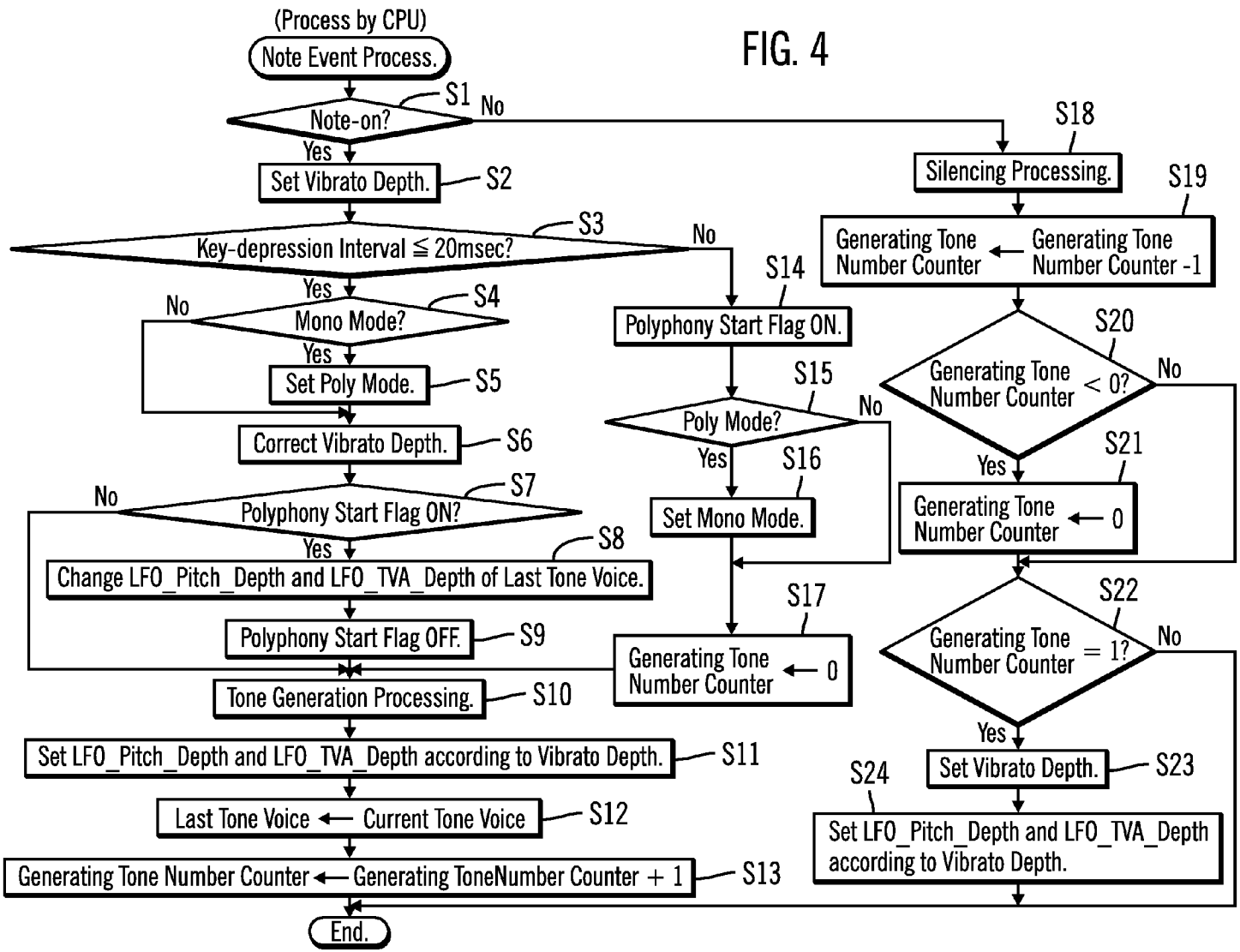
FIG. 4 is a flow chart showing a note event process executed by the CPU of the electronic musical instrument.

Next, referring to FIG. 4, the process executed by the CPU 11 of the electronic musical instrument 1 in accordance with described embodiments having the above-described configuration will be described. FIG. 4 is a flow chart of a note event process executed by the CPU 11. The note event process is executed each time the CPU 11 receives a note event (a note-on or a note-off) from the keyboard 2, when the tone color of a violin is set.

As shown in FIG. 4, in the note event process, first, it is judged as to whether or not a note event received from the keyboard 2 is a note-on (S1). When it is judged in S1 that the note event received is a note-on (S1: Yes), a vibrato depth to be applied to a single tone is stored as an initial value in the vibrato depth memory 13*d*, thereby setting the vibrato depth (S2). The vibrato depth to be applied to a single tone is stored as fixed value data in the ROM 12.

After the processing in S2, the key-depression time memory 13*e* is looked up to judge as to whether or not the key-depression interval between the current note (the note key-depressed this time) and the last note (the note key-depressed last time) is equal to 20 msec or less (S3).

When it is judged in S3 that the key-depression time interval exceeds 20 msec (S3: No), the polyphony start flag 13*a* is set to ON (S14). In S3, if the key-depression time of the previous note does not exist in the key-depression time memory 13*e*, the process also proceeds to S14 and the polyphony start flag 13*a* is set to ON. Then, it is judged as to whether or not the mode set at the sound source 14 is a poly mode (a mode that is capable of concurrently generating two or more tones) (S15).

When it is judged in S15 that the mode set at the sound source 14 is the poly mode (S15: Yes), the mode at the sound source 14 is set to a mono mode (a mode that prohibits concurrent generation of two or more tones) (S16), and the process proceeds to S17.

In other words, when the key-depression interval between the current note and the last note exceeds 20 msec and the mode of the sound source 14 is the poly mode, the current note is specified as a note that is key-depressed as a single tone after the performer key-depressed multiple notes as polyphony in the last and prior notes. Then, the processing in S16 is executed, whereby the mode of the sound source 14 is set to the mono mode. In this case (S3: No, and S15: Yes), the mode of the sound source 14 is switched from the poly mode to the mono mode. Therefore, even when tones corresponding to all or a part of notes composing polyphony are being generated, the sound source 14 forcefully silences the tones being generated, and generates only a tone corresponding to the current note. Accordingly, the tone corresponding to the current note can be generated like a single tone as intended by the performer.

On the other hand, when it is judged in S15 that the mode set at the sound source 14 is the mono mode (S15: No), the process proceeds to S17 without changing the mode of the sound source 14 as being the mono mode. In this case (S3: No, and S15: No), the mode of the sound source 14 is also the mono mode. Therefore, even when there are tones being generated, the sound source 14 can forcefully silence the tones being generated, and generate only a tone corresponding to the current note as a single tone.

In S17, the generating tone number counter 13*b* is zeroed (S17). After the processing in S17, a tone generation processing according to the note-on received from the keyboard 2 is executed (S10). More specifically, the tone generation instruction is outputted after a vacant voice in the sound source 14 is assigned for the tone generation instruction corresponding to the note-on received. In this instance, in the note-on map (not shown) in the RAM 13, the tone generation flag corresponding to the current note is set to ON, and information indicative of the voice-assigned voice is stored.

After executing the tone generation processing (S10), LFO_Pitch_Depth and LFO_TVA_Depth corresponding to the vibrato depth stored in the vibrato depth memory 13*d* are set for the voice assigned with respect to the tone generation instruction (S11). It is noted that the set values of LFO_Pitch_Depth and LFO_TVA_Depth may be decided by referring to the parameter deciding table (see FIG. 3).

As the operations in S10 and S11 are executed, the sound source 14 adds the vibrato effect corresponding to the vibrato depth stored in the vibrato depth memory 13*d* to a tone corresponding to the current note, and generates the tone. Therefore, when the current note is key-depressed at an interval exceeding 20 msec from the last note (in other words, S3: No), the vibrato depth set in S2, in other words, vibrato according to the vibrato to be applied to a single tone, is added to the tone corresponding to the current note.

After the processing in S11, information indicative of the voice assigned with respect to the tone generation instruction of the current note (in other words, the current voice) is stored, as last tone voice information, in the previous voice information memory 13*c* (S12). Then, 1 is added to the generating tone number counter 13*b* (S13), and the note event process is ended.

On the other hand, when it is judged in S3 that the key-depression interval is equal to 20 msec or less (S3: Yes), the current note is specified as a note that is key-depressed by the performer intended, together with the last note, for polyphony (key-depressed as a chord). Then, it is judged as to whether or not the mode set at the sound source 14 is the mono mode (S4).

When it is judged in S4 that the mode set at the sound source 14 is the mono mode (S4: Yes), the mode of the sound source 14 is set to the poly mode (S5), and the process proceeds to S6. In other words, when the key-depression interval between the current note and the last note is equal to 20 msec or less, the current note is specified as a note key-depressed by the performer for polyphony together with the last note. Then, the processing in S5 is executed, thereby setting the mode of the sound source 14 to the poly mode. As the mode of the sound source 14 is switched to the poly mode, the sound source 14 can generate a tone corresponding to the current note concurrently with a tone corresponding to the last note. Therefore, the tone corresponding to the current note can be generated in polyphony as intended by the performer.

On the other hand, when it is judged in S4 that the mode set at the sound source 14 is the poly mode (S4: No), the mode of the sound source 14 is not changed, and the process proceeds to S6.

In S6, the vibrato depth stored in the vibrato depth memory 13*d* is corrected to zero (S6). After the processing in S6, it is judged as to whether or not the polyphony start flag 13*a* is ON (S7). When the polyphony start flag 13*a* is ON (S7: Yes), the LFO_Pitch_Depth and LFO_TVA_Depth are set for the voice assigned to the last note (hereafter this voice is referred to as the "last tone voice") based on the last tone voice information (S8). It is noted that the last tone voice information is stored in the previous tone voice information memory 13*c*. Further, LFO_Pitch_Depth and LFO_TVA_Depth are set according to the vibrato depth stored in the vibrato depth memory 13*d*.

The vibrato depth stored in the vibrato depth memory 13*d* has been corrected to zero by the processing in S6. Accordingly, as the processing in S8 is executed, the vibrato effect added to the tone corresponding to the last note being generated becomes zero. In other words, no vibrato is added to the tone corresponding to the last note.

As described above, the polyphony start flag 13*a* is set to ON by the processing in S14 when the key-depression interval between the current note and the last note exceeds 20 msec. Therefore, when the key-depression interval between the current note and the last note is equal to 20 msec or less, and the polyphony start flag 13*a* is ON (S3: Yes, and S7: Yes), the last note can be specified as a note first processed among notes composing polyphony. However, the last note, despite being a note composing polyphony, is judged as No in S3 at the time when the note-on is inputted (in other words, processed as a single tone), and is therefore outputted with a vibrato effect added thereto according to the vibrato depth to be applied to a single tone.

Therefore, when the key-depression interval between the current note and the last note is equal to 20 msec or less, and the polyphony start flag 13*a* is ON (S3: Yes, and S7: Yes), the current note is specified as a note to be processed second among notes composing polyphony. Then, the vibrato effect for a single note added to the tone that has been processed first and is being generated (in other words, the tone corresponding to the last note) is automatically set to zero. Accordingly, awkwardness in which vibrato is added only to a tone of a note processed first among notes composing polyphony can be eliminated. By this, the characteristic of a violin (a solo musical instrument capable of polyphony) having a tendency in which vibrato is not added at the time of performing polyphony can be imitated to a high level.

After the processing in S8, the polyphony start flag 13*a* is set to OFF (S9), and the process proceeds to S10. Also, when it is judged in S7 that the polyphony start flag 13*a* is OFF (S7: No), the current note is a note that is processed third or later among notes composing polyphony, and the vibrato effect to be added to tones being generated as polyphony has already been set to zero. Therefore, the process proceeds to S10 without executing the operations in S8 and S9.

In S10, as the tone generation processing described above, the tone generation instruction is outputted after a vacant voice in the sound source 14 is assigned for the tone generation instruction corresponding to the note-on of the current note (S10). After executing the processing in S10, the LFO_Pitch_Depth and LFO_TVA_Depth corresponding to the vibrato depth stored in the vibrato depth memory 13*d* are set (S11). When the current note is key-depressed at an interval equal to 20 msec or less from the last note (in other words, S3: Yes), the values of the LFO_Pitch_Depth and LFO_TVA_Depth set according to the vibrato depth corrected in S6 are set for a tone corresponding to the current note. As described above, the vibrato depth is corrected to zero in S6, the values of the LFO_Pitch_Depth and LFO_TVA_Depth are also set to zero, whereby vibrato is not added to the tone corresponding to the current note.

After the processing in S11, information about the present voice is stored in the previous tone voice information memory 13*c* as last tone voice information (S12). Then, 1 is added to the generating tone number counter 13*b* (S13), and the note event process is ended.

Also, when it is judged in S1 that the received note event is a note-off (S1: No), a silencing process according to the received note-off is executed (S18). More specifically, the note-on map (not shown) in the RAM 13 is looked up, and a silencing instruction according to the received note-off is outputted to a corresponding voice. By this, the tone generation corresponding to the note that has been key-released is silenced.

After the processing in S18, one is subtracted from the generating tone number counter 13*b* (S19), and it is judged as to whether or not the value of the generating tone number counter 13*b* is a negative value (S20). At this time, when it is judged that the value of the generating tone number counter 13*b* is a negative value (S20: Yes), the value of the generating tone number counter 13*b* is set to zero (S21), and the process proceeds to S22. On the other hand, when it is judged that the value of the generating tone number counter 13*b* is not a negative value (S20: No), the process proceeds to S22.

It is judged in S22 as to whether or not the value of the generating tone number counter 13*b* is one (S22). When it is judged that the value of the generating tone number counter 13*b* is not one (S22: No), then the note event process is ended. On the other hand, when it is judged that the value of the generating tone number counter 13*b* is one (S22: Yes), the vibrato depth stored in the ROM 12 (in other words, the vibrato depth to be applied to a single tone) is stored as an initial value in the vibrato depth memory 13*d*. By this, the vibrato depth is set (S23).

After the processing in S23, the note-on map (not shown) in the RAM 13 is looked up, and the LFO_Pitch_Depth and LFO_TVA_Depth are set for the voice assigned to the note being generated (S24). Here, the LFO_Pitch_Depth and LFO_TVA_Depth are set according to the vibrato depth stored in the vibrato depth memory 13*d*. Then, the note event process is ended.

The vibrato depth stored in the vibrato depth memory 13*d* is set to the vibrato depth to be applied to a single tone by the processing in S23. Therefore, when the processing in S24 is executed, the vibrato effect according to the vibrato depth to be applied to a single tone is added to the tone being generated. In other words, vibrato according to the vibrato depth to be applied to a single tone is added again to the tone being generated.

In other words, upon receiving a note-off, and the value of the generated tone number counter 13*b* becomes one, accompanying the reception of the note-off (S1: No, and S22: Yes), it is specified that, after having key-depressed multiple notes in the last and prior notes as polyphony, the performer gradually releases the keys into a state where only the last one key is kept depressed. Then, the vibrato effect according to the vibrato depth to be applied to a single tone is automatically resumed for the remaining one tone. By this, the characteristic of a violin (a solo musical instrument capable of polyphony) having a tendency in which vibrato is not added at the time of performing polyphony but vibrato is added to a single tone can be imitated in a highly sophisticated manner.

As described above, according to the electronic musical instrument 1 of described embodiments, based on the key-depression interval of successive key-depressions (in other words, the input interval between note-ons), it is discriminated as to whether these successive key-depressions are intended for polyphony or for single tones, whereby the vibrato effect to be added to the tone is controlled. Therefore, it is possible to achieve highly sophisticated imitation of performance characteristic of a solo musical instrument capable of polyphony, such as, a violin based on real-time performance operation by the performer.

In particular, when it is specified, based on the key-depression interval, that the current key-depression has been made by the performer intended for polyphony, and when the sound source 14 is set to the mono mode, the setting of the sound source 14 is changed to the poly mode. In this manner, by discriminating between key-depressions intended for polyphony and key-depressions for single tones, the tone generation characteristic of a solo musical instrument capable of polyphony such as a violin can be imitated in a highly sophisticated manner.

Also, when it is specified, based on the key-depression interval, that the current key-depression has been made by the performer intended for single tones, and when the sound source 14 is set in the poly mode, the setting of the sound source 14 is changed to the mono mode. Therefore, when key-depressions have been made by the performer intended for single tones, even when tones based on polyphony are being generated (in other words, corresponding keys are being key-depressed), the tones being generated are forcefully silenced, and only a tone based on the current key-depression is generated. Accordingly, the tone corresponding to the current note can be sounded like a single tone as intended by the performer. In other words, even when a key-depression intended for a single tone is made by the performer, before releasing keys that have been key-depressed as intended for polyphony, tone generation in a manner intended by the performer can be made.

The invention has been described with respect to various embodiments, but the invention is not limited to the embodiments described above, and it can be readily presumed that various changes and improvements can be made to the described embodiments that do not depart from the subject matter of the invention.

For example, in certain of the embodiments described above, the process shown in FIG. 4 is executed by the CPU 14 to imitate performance of a solo musical instrument capable of polyphony such as a violin to a high level. Instead, operations corresponding to the process shown in FIG. 4 may be executed by the sound source 14.

In certain of the embodiments described above, the process shown in FIG. 4 is executed when the tone color of a violin is set. Instead, without any particular limitation to the violin, the process may be similarly applicable to any tone color of a solo musical instrument capable of polyphony like a violin.

Also, in certain of the embodiments described above, when the key-depression interval between the current note and the last note exceeds 20 msec, the mode of the sound source 14 is changed from the poly mode to the mono mode. Instead, the mode of the sound source 14 may be changed from the poly mode to the mono mode when the value of the generating tone number counter 13*b* becomes one, along with key-release of the keys 2*a*.

More specifically, in accordance with the modified embodiments, the operations in S15-S17 in the note event process in the present embodiment (see FIG. 4) are omitted. Instead of the above, when it is judged that the value of the generating tone number counter 13*b* is one (S22: Yes), it may be judged as to whether or not the mode of the sound source 14 is the poly mode. When the mode is judged to be the poly mode, the mode of the sound source 14 may be set to the mono mode, and then the processing in S23 may be executed. On the other hand, when the mode of the sound source 14 is not the poly mode, in other words, when it is judged to be the mono mode, the mode of the sound source 14 may be kept in the mono mode, and the processing in S23 may be executed.

According to the embodiment above, when a key-depression intended for a single tone is made before the performer releases keys that have been key-depressed to be intended for polyphony, the tone based on the current note is generated as a tone with vibrato added, together with tones being generated based on polyphony without vibrato added. Even so, however, the characteristic of a violin (i.e., a solo musical instrument capable of polyphony) having a tendency in which vibrato is not added at the time of performing polyphony, but vibrato is added to a single tone can be sufficiently imitated. According to the above embodiments, occasions of mode switching of the sound source 14 can be reduced, which is advantageous in reducing the controlling load.

Also, in the note event process of the embodiment described above (see FIG. 4), the vibrato depth stored as fixed value data in the ROM 12 is set as an initial value in S2 and S23. Instead, a predetermined fixed value of the vibrato depth may be changed according to the key-depression strength (velocity) of the current note, and the changed value may be set as an initial value.

Also, according to the note event process of the present embodiment described above, when the key-depression interval between the current note and the last note is equal to 20 msec or less, the processing in S6 is executed to correct the vibrato depth stored in the vibrato depth memory 13*d* to zero, whereby vibrato is not added to each of the tones composing polyphony. Instead, in S6, the vibrato depth stored in the vibrato depth memory 13*d* may be multiplied by a predetermined ratio (for example, 0.05), thereby reducing the vibrato depth smaller. Even with such a composition, vibrato added to each of the tones comprising polyphony can be suppressed to a smaller level than the vibrato to be applied to a single tone. Therefore, with the embodiments, the characteristic of a solo musical instrument capable of polyphony, such as, a violin, having a tendency in which vibrato is not added at the time of performing polyphony, can be imitated in a highly sophisticated manner.

Also, in the note event process of the embodiment described above, when it is judged in S7 that the polyphony start flag 13*a* is ON (S7: Yes), the values of the LFO_Pitch_Depth and LFO_TVA_Depth of the last tone voice are modified according to the vibrato depth corrected by the processing in S6. However, when a note-on is inputted, only the content of a voice corresponding to the note first processed among notes composing polyphony being generated is changed. Instead, each time the number of notes composing polyphony increases, the value of the vibrato depth to be corrected by the processing in S6 may be made smaller, whereby the values of the LFO_Pitch_Depth and LFO_TVA_Depth of voices corresponding to notes composing polyphony processed in the last and prior notes may be changed. By this, the more the number of tones in polyphony, the less the vibrato is added.

Also, according to the embodiment described above, when the current note composes polyphony together with the last note, the vibrato depth of the current voice and the vibrato depth of the last voice are set to the same value (i.e., zero in the embodiment described above). However, the vibrato depth of the current voice and the vibrato depth of the last voice do not need to be the same value and may be different values, as long as they are smaller than the initial value of the vibrato depth (the vibrato depth stored as fixed value data in the ROM 12).

In certain described embodiments, when it is judged, based on the key-depression interval between the current note and the last note, that the current note composes polyphony together with the last note, and the polyphony start flag 13*a* is ON (S3: Yes, and S7: Yes), the vibrato depth of the last voice is made smaller. Instead, when it is judged that the current note composes polyphony together with the last note (S3: Yes), the vibrato depth for the entire tones being generated may be made smaller. However, tones being generated with another tone color may not be subject to change of the vibrato depth. With such a configuration, only the LFO_Pitch_Depth and LFO_TVA_Depth need to be instructed as modulation amounts to the sound source 14, and information concerning voices becomes unnecessary. In this case, for voices in the sound source 14 whose vibrato depth (LFO_Pitch_Depth and LFO_TVA_Depth) has already been set smaller, if the vibrato depth remains to be the same as before, the processing to change the vibrato depth may be omitted. By this configuration, for voices whose vibrato depth has already been set smaller, the sound source 14 does not make the vibrato depth smaller again.

In certain described embodiments, the previous tone voice information memory 13*c* stores information indicative of a voice corresponding to a note-on received. In the processing in S8 executed when the current note and the last note compose polyphony, the vibrato depth (LFO_Pitch_Depth and LFO_TVA_Depth) of the last voice is set based on the information indicative of the voice stored in the previous tone voice information memory 13*c*. Instead, the pitch of a note-on received may be stored in the previous tone voice information memory 13*c* and, in S8, the vibrato depth of the last tone voice may be set based on the pitch stored in the previous tone voice information memory 13*c*. In this way, information on voices does not need to be stored.

In the embodiment described above, when it is judged, based on the key-depression interval between the current note and the last note, that the current note composes polyphony together with the last note, and the polyphony start flag 13*a* is ON (S3: Yes, and S7: Yes), the vibrato depth of the last voice is made smaller. Instead, when it is judged that the current note composes polyphony together with the last note (S3: Yes), it is possible to configure such that the vibrato depth of the last voice is always made smaller. With such a configuration, the polyphony start flag 13*a* may not be used. In this case, for voices in the sound source 14 whose vibrato depth (LFO_Pitch_Depth and LFO_TVA_Depth) has already been set smaller, if the vibrato depth remains to be the same as before, the processing to change the vibrato depth may be omitted. By this configuration, when three or more tones are to be generated as polyphony, for voices whose vibrato depth has already been set smaller, the sound source 14 does not make the vibrato depth smaller again.

Also, in the embodiment described above, in the note event process shown in FIG. 4, as the threshold value for judging as to whether or not the current note and the last note compose polyphony (in other words, the threshold value of the key-depression interval for executing the judgment processing in S3), 20 msec is used. However, the threshold value is not limited to this specific value, and other values, for example, 10 msec, 30 msec or the like may be used.

Also, the note event process of the embodiment described above is configured such that, when the key-depression interval is equal to 20 msec or less, it is judged, based on the setting of the polyphony start flag 13*a*, as to whether or not the current note is a note that is processed first among notes composing polyphony. Instead, it can be configured to specify as to whether or not the current note is a note that is processed first among notes composing polyphony, according to whether or not the setting of the sound source 14 is the mono mode. More specifically, in the note event process shown in FIG. 4, when it is judged in S3 that the key-depression interval between the current note and the last note is equal to 20 msec or less (S3: Yes), the operations in S4 and S5 may be omitted, and the processing in S6 may be executed. Then, instead of the judgment processing in S7, it may be judged as to whether or not the mode of the sound source 14 is the mono mode. Further, when the mode of the sound source 14 is judged to be the mono mode, the processing in S8, and a processing to set the mode of the sound source 14 to the poly mode may be executed, and then the tone generation processing (S10) may be executed. On the other hand, when the mode of the sound source 14 is judged to be the poly mode, the tone generation processing (S10) may be executed while leaving the mode of the sound source 14 as being the poly mode.

In the described embodiments, the tone control device may be mounted on the electronic musical instrument 1 constructed in one piece with the keyboard 2. Alternatively, the tone control device may be configured to be mounted on a sound source module to which a keyboard that outputs note-on and note-off signals can be detachably connected, like the keyboard 2. Yet further, the tone control device may be configured independently from the sound source 14.

What is claimed is:

1. A tone control device in communication with a tone generation device to generate a plurality of tones and modify tones, comprising:

an input device configured to input tone generation instructions to generate tones with predetermined pitches and to input silencing instructions to silence the tones with the predetermined pitches;

an instruction device that outputs tone control instructions to the tone generation device to generate tones or silence tones according to the tone generation instructions and silencing instructions inputted by the input device; and an interval judgment device that determines whether an input interval between a current tone generation instruction inputted from the input device and a last tone generation instruction inputted from the input device is less than or equal to a predetermined time;

wherein the instruction device instructs the tone generation device to:

set a tone modulation amount to a predetermined value in response to determining that the input interval is greater than the predetermined time;

set the tone modulation amount to a value smaller than the predetermined value in response to determining that the input interval is less than or equal to the predetermined time; and set a performance mode in a memory device to a single tone mode, in which only one note is generated, or a polyphonic mode, in which multiple notes are simultaneously generated, based on the determined input interval.

2. The tone control device of claim 1, further comprising:

a count device that counts a number of tones being generated by the tone generation device, wherein the instruction device instructs the tone generation device to set the tone modulation amount to the predetermined value when the count device is decremented to one.

3. A tone control device in communication with a tone generation device to generate a plurality of tones and modify tones, comprising:

an input device configured to input tone generation instructions to generate tones with predetermined pitches and to input silencing instructions to silence the tones with the predetermined pitches;

an instruction device that outputs tone control instructions to the tone generation device to generate tones or silence tones according to the tone generation instructions and silencing instructions inputted by the input device; and an interval judgment device that determines whether an input interval between a current tone generation instruction inputted from the input device and a last tone generation instruction inputted from the input device is less than or equal to a predetermined time wherein the instruction device instructs the tone generation device to:

set a tone modulation amount to a predetermined value in response to determining that the input interval is greater than the predetermined time;

set the tone modulation amount to a value smaller than the predetermined value in response to determining that the input interval is less than or equal to the predetermined time;

set a polyphonic mode capable of concurrently generating two or more tones in response to the interval judgment device determining that the input interval is less than or equal to the predetermined time; and set a mono mode that prohibits concurrent generation of multiple tones in response to the interval judgment device determining that the input interval is greater than the predetermined time.

4. A tone control device in communication with a tone generation device to generate a plurality of tones and modify tones, comprising:

an input device configured to input tone generation instructions to generate tones with predetermined pitches and to input silencing instructions to silence the tones with the predetermined pitches;

an instruction device that outputs tone control instructions to the tone generation device to generate tones or silence tones according to the tone generation instructions and silencing instructions inputted by the input device; and an interval judgment device that determines whether an input interval between a current tone generation instruction inputted from the input device and a last tone generation instruction inputted from the input device is less than or equal to a predetermined time;

a count device that counts a number of tones being generated by the tone generation device;

wherein the instruction device instructs the tone generation device to:

set a tone modulation amount to a predetermined value in response to determining that the input interval is greater than the predetermined time;

set the tone modulation amount to a value smaller than the predetermined value in response to determining that the input interval is less than or equal to the predetermined time;

set a poly mode that is capable of concurrently generating multiple tones in response to the interval judgment device determining that the input interval is less than or equal to the predetermined time; and set a mono mode that prohibits concurrent generation of multiple tones when the count device is decremented to one.

5. A method, comprising:

receiving a current note-on event for a current note at a current time from an input device of an electronic musical instrument;

determining a key depression interval comprising a difference of the current time from a previous time of a previous note;

setting a performance mode in a memory device to a single tone mode, in which only one note is generated, or a polyphonic mode, in which multiple notes are simultaneously generated, based on the determined key depression interval;

generating a tone to control a sound source to output the current note with a first modulation magnitude in response to determining that the performance mode is the single tone mode;

generating a tone to control the sound source to output the current note with a second modulation magnitude in response to determining that the performance mode is the polyphonic mode, wherein the first modulation magnitude is greater than the second modulation magnitude.

6. The method of claim 5, wherein the first and second modulation magnitudes provide a vibrato effect to a note being generated, wherein the first modulation mode provides a greater vibrato effect than the second modulation mode, and wherein the vibrato effect is comprised of a low frequency oscillator (LFO) pitch depth that defines a vibrato depth, wherein the LFO pitch depth has an increasing relation with respect to an increase in the vibrato depth.

7. The method of claim 5, wherein the performance mode is set to the single tone mode in response to determining that the key depression interval exceeds a predetermined value and wherein the performance mode is set to the polyphonic mode in response to determining that the key depression interval is less than the predetermined value.

8. The method of claim 5, further comprising;

receiving a note-off event for a note being played;

generating a silence instruction to cause the sound source to silence the note for which the note-off event was received;

determining whether only one note is being generated after the note subject to the note-off event is silenced; and generating the only one note being generated with the first modulation magnitude in response to determining that there is only one note being generated.

9. The method of claim 5, further comprising:

generating a silencing instruction to the sound source to silence at least one note being generated other than the current note so that only the current note is being generated in response to determining that the performance mode is the single tone mode.

10. The method of claim 5, further comprising:

setting a polyphony start flag to a first value indicating that the current note is a first note to be processed during a subsequent polyphonic mode in response to determining that the performance mode is single mode; and setting the polyphony start flag to a second value indicating that a next note in the polyphonic mode is not a first note to be processed in the polyphonic mode in response to determining that the performance mode is polyphonic mode.

11. The method of claim 10, further comprising:

changing a generation of a last note for which a previous note-on event was received immediately preceding the current note-on event to have the sound source generate the last note with the second modulation magnitude in response to determining that the performance mode is the polyphonic mode and that the polyphony flag is set to the first value; and setting the polyphony start flag to the second value after changing the generation of the last note.

12. The method of claim 5, wherein the second modulation magnitude is a predetermined ratio of the first modulation magnitude, wherein a plurality of different modulation magnitudes are applied to a plurality of notes being generated in the polyphonic mode, and wherein the different modulation magnitudes are less than the first modulation magnitude.

13. A tone control device coupled to an electronic musical instrument input device and a sound source, comprising:

a processor;

a memory;

a computer readable storage device including a control program executed by the processor to perform operations, the operations comprising:

receiving a current note-on event for a current note at a current time from the input device;

determining a key depression interval comprising a difference of the current time from a previous time of a previous note;

setting a performance mode in the memory to a single tone mode, in which only one note is generated, or a polyphonic mode, in which multiple notes are simultaneously generated, based on the determined key depression interval;

generating a tone to control a sound source to output the current note with a first modulation magnitude in response to determining that the performance mode is the single tone mode;

generating a tone to control the sound source to output the current note with a second modulation magnitude in response to determining that the performance mode is the polyphonic mode, wherein the first modulation magnitude is greater than the second modulation magnitude.

14. The tone control device of claim 13, wherein the first and second modulation magnitudes provide a vibrato effect to a note being generated, wherein the first modulation mode provides a greater vibrato effect than the second modulation mode, and wherein the vibrato effect is comprised of a low frequency oscillator (LFO) pitch depth that defines a vibrato depth, wherein the LFO pitch depth has an increasing relation with respect to an increase in the vibrato depth.

15. The tone control device of claim 13, wherein the performance mode is set to the single tone mode in response to determining that the key depression interval exceeds a predetermined value and wherein the performance mode is set to the polyphonic mode in response to determining that the key depression interval is less than the predetermined value.

16. The tone control device of claim 13, wherein the operations further comprise:

receiving a note-off event for a note being played;

generating a silence instruction to cause the sound source to silence the note for which the note-off event was received;

determining whether only one note is being generated after the note subject to the note-off event is silenced; and generating the only one note being generated with the first modulation magnitude in response to determining that there is only one note being generated.

17. The tone control device of claim 13, wherein the operations further comprise:

generating a silencing instruction to the sound source to silence at least one note being generated other than the current note so that only the current note is being generated in response to determining that the performance mode is the single tone mode.

18. The tone control device of claim 13, wherein the operations further comprise:

setting a polyphony start flag to a first value indicating that the received current note is a first note to be processed during a subsequent polyphonic mode in response to determining that the performance mode is single mode; and setting the polyphony start flag to a second value indicating that a next note in the polyphonic mode is not a first note to be processed in the polyphonic mode in response to determining that the performance mode is polyphonic mode.

19. The tone control device of claim 18, wherein the operations further comprise:

changing a generation of a last note for which a previous note-on event was received immediately preceding the current note-on event to have the sound source generate the last note with the second modulation magnitude in response to determining that the performance mode is the polyphonic mode and that the polyphony flag is set to the first value; and setting the polyphony start flag to the second value after changing the generation of the last note.

20. The tone control device of claim 13, wherein the second modulation magnitude is a predetermined ratio of the first modulation magnitude, wherein a plurality of different modulation magnitudes are applied to a plurality of notes being generated in the polyphonic mode, and wherein the different modulation magnitudes are less than the first modulation magnitude.

* * * * *